United States Patent [19]

Finch et al.

[11] Patent Number: 4,807,687

[45] Date of Patent: Feb. 28, 1989

[54] SECURITY DOOR SYSTEM

[76] Inventors: Harry E. Finch, 5273 Vista del Sol, Cypress, Calif. 90630; Geza J. Szayer, 24771 Acropolis Dr., Mission Viejo, Calif. 92691

[21] Appl. No.: 846,341

[22] Filed: Mar. 31, 1986

[51] Int. Cl.[4] ..... E06B 9/08

[52] U.S. Cl. ..... 160/133; 160/23.1; 160/271; 292/152

[58] Field of Search ..... 160/133, 23 R, 26, 25, 160/31, 113; 292/345, 150, 152; 70/1.5

[56] References Cited

U.S. PATENT DOCUMENTS

| | | | |
|---|---|---|---|
| 1,436,620 | 11/1922 | Bethge et al. | 70/1.5 |
| 2,350,287 | 5/1944 | Michelman | 160/133 |
| 2,520,618 | 8/1950 | Winter | 160/133 X |
| 3,078,917 | 2/1963 | Recchione | 160/25 X |
| 3,734,161 | 5/1973 | Pierce | 160/133 |
| 3,850,465 | 11/1974 | Hill et al. | 160/133 X |
| 4,365,660 | 12/1982 | Henkenjohann | 160/133 |
| 4,428,218 | 1/1984 | LaRocca | 160/235 X |
| 4,449,562 | 5/1984 | Leivenzon et al. | 160/113 |
| 4,452,292 | 6/1984 | Lievenzon et al. | 160/133 |
| 4,565,078 | 1/1986 | Solomon | 292/150 X |
| 4,583,706 | 4/1986 | Whitehouse et al. | 160/133 X |

FOREIGN PATENT DOCUMENTS

| | | | |
|---|---|---|---|
| 2034384 | 6/1980 | United Kingdom | 160/133 |

*Primary Examiner*—Ramon O. Ramirez
*Assistant Examiner*—David M. Purol
*Attorney, Agent, or Firm*—Henry M. Bissell

[57] ABSTRACT

A security door system using a roll-up door fabricated of curtain sections reinforced by extruded metal cross beams. The system is designed for installation in a closet doorway or the like to provide security for valuables which may be stored in the closet or to keep dangerous implements, such as guns, away from children in a household, and the like. The door has a slide lock with a re-lock assembly for back up in the event that the primary key lock is broken. The door is designed for shipment in kit form and includes a number of door track sections with mating splices for joining the sections together. The design and construction of the system provide a low cost solution to the problem of developing secure storage within a residence, school, business establishment or the like in a unit which is aesthetically pleasing in design and is inexpensive to purchase and install.

19 Claims, 5 Drawing Sheets

FIG. 2
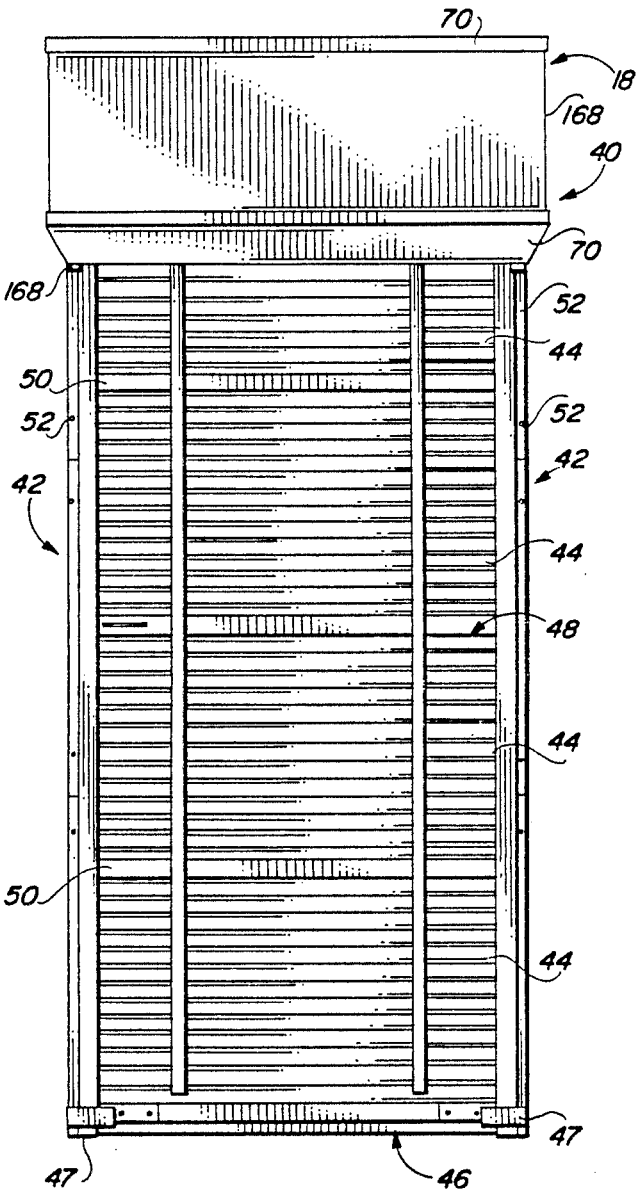
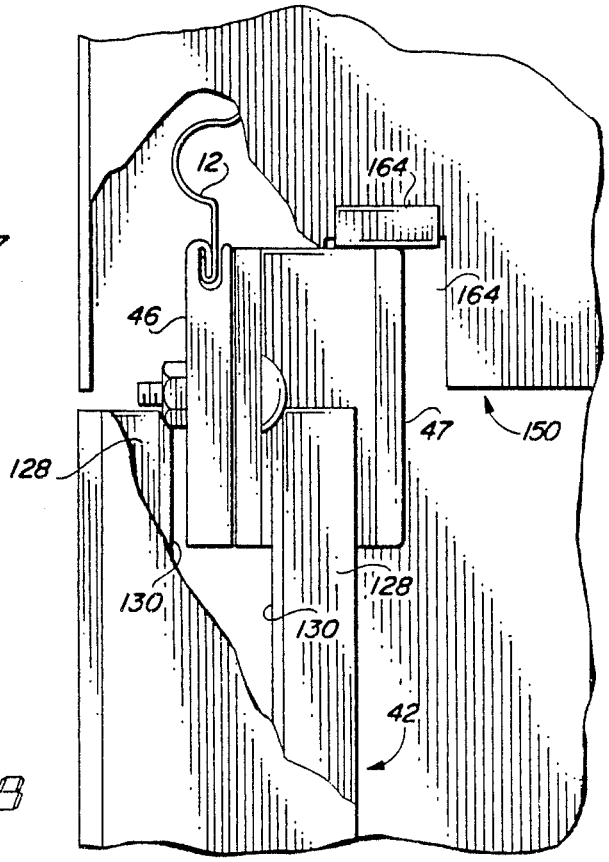
FIG. 18

FIG. 15
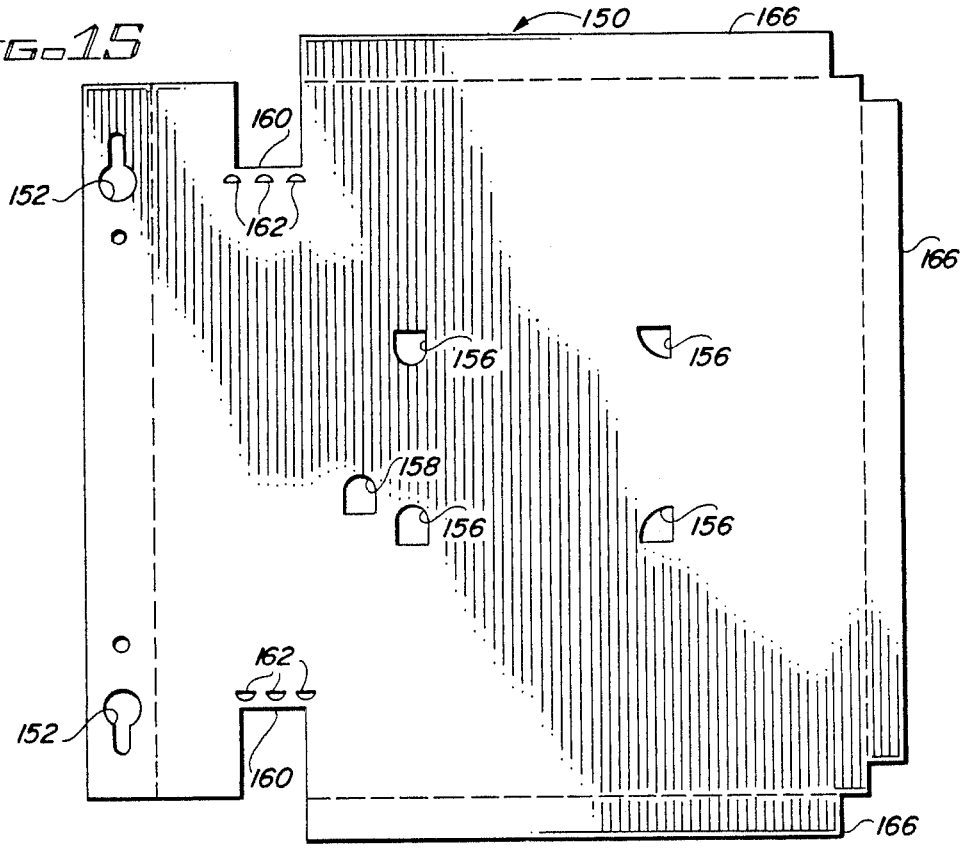
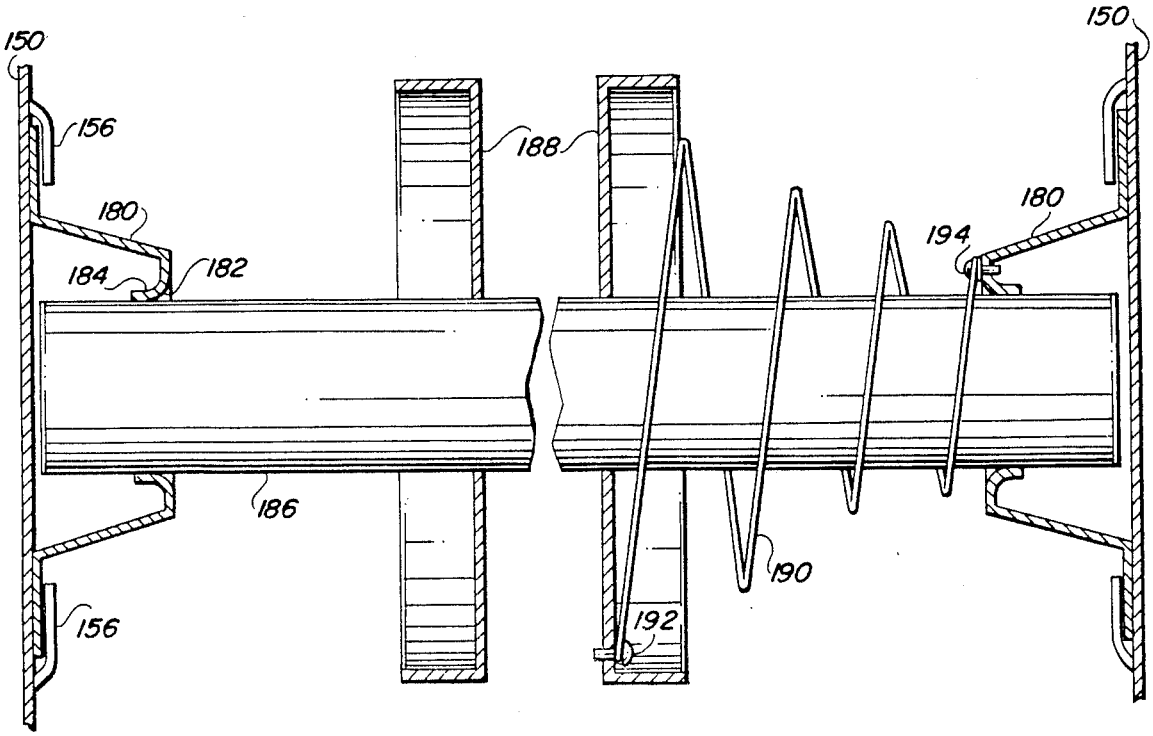
FIG. 17

SECURITY DOOR SYSTEM

BACKGROUND OF THE INVENTION

1. Field of the Invention

This invention relates to doors and mounting arrangements therefor and, more particularly, to such a combination which may be readily installed in a closet door opening or the like to establish an easily positioned, lockable barrier for security purposes.

2. Description of the Prior Art

Roll-up doors constitute a convenient way of providing a door closure in a fairly limited space. This type of door is commonly used in so-called mini-warehouse or mini-storage facilities that are now generally available in metropolitan areas for storage rentals. Such doors, or curtains as they are sometimes called, are typically constructed of a sheet of relatively thin metal which is formed by stamping or rolling to provide a plurality of horizontal corrugations extending from edge to edge of the door. This construction permits the door to be rolled up as it is raised for opening so that it can be stored in a cylindrical configuration at the top of the door opening. Vertical tracks, which may be of extruded aluminum, are typically mounted at opposite sides of the opening and serve to guide the door as it moves up and down. During opening, the door is rolled about a barrel assembly which is constructed with a heavy wall, steel-tube axle and two or more galvanized steel drums, or wheels, mounted between brackets located slightly above the upper corners of the door opening. Adhesively affixed tapes extend along the inner face of the door where contact with the barrel assembly is made to protect the door against wear by the wheels and avoid rubbing of successive layers of the rolled-up door against each other. The barrel assembly is biased by tempered steel torsion springs to balance the weight load of the door, so that it can be easily raised or lowered in a simple one-hand operation.

Such a door construction presents a number of desirable features for the applications mentioned above. Thus, the door is relatively easy to operate, can be stored in a limited space and quite out of the way, can be constructed of readily fabricatable components, can be locked in a closed position, and is relatively simple and easy to install. These desirable attributes are adopted in arrangements in accordance with the invention which provide an improved roll-up door for a particular application.

SUMMARY OF THE INVENTION

In brief, arrangements in accordance with the present invention comprise a roll-up door of the general type described hereinabove but with particular structural features incorporated therein which render the door system effective as a security barrier for protecting property within a closet, or the like against unauthorized access. The security door system of the present invention is designed for ready installation by a home handyman, the so-called "do-it-yourselfer", and is constructed for sale as a kit which may be readily transported from the manufacturer to the point-of-sale, and from the point-of-sale to the purchaser's home where it may be easily installed with a few simple tools. In this particular application of the invention, the security door system is designed to be mounted inside a closet or the like, attached to the back of the door frame. As thus installed, there is no interference with the conventional outwardly opening door which is mounted by hinges to close into the door frame. Thus, the conventional closet door may be closed in normal fashion so that the security door system is concealed by the conventional closet door.

In accordance with one aspect of the present invention, the barrel assembly is totally enclosed in a housing, finished in attractive woodgrain or other aesthetically pleasing finish, which completely covers and encloses the roll-up mechanisms. The roll-up door is provided with aluminum reinforcing beams extending horizontally and spaced at intervals along the vertical extent of the door to provide added strength and security. These security beams are heavy duty extruded metal cross beams which are provided with an interlocking edge configuration to mate with a correspondingly configured edge of an adjacent section of the corrugated door panel so that the entire reinforced panel can be readily rolled up about the barrel assembly while preserving the integrity of the security door system. One of these beams is provided with a steel slide bolt which is secured by a five disc tumbler to lock the door against vertical movement to open it. This locking arrangement includes a unique re-lock mechanism which prevents the slide bolt from being withdrawn from the locked position, should the tumbler lock be forceably disabled. A second slide bolt is provided near the opposite end of the slide bolt beam and is operable manually from the inside. This permits the security door system of the invention to provide a modicum of protection for a person inside the closet against an intruder on the outside.

The entire door assembly is designed and fabricated for transport and storage in kit form. The door is rolled into a cylinder about the axle and drum assembly including at least one pre-tensioned torsion spring. The vertical metal door guides which match the vertical height of a standard closet are formed in sections, and simple but effective joining members are provided to permit assembly of the sections into reasonably permanent, full length door guides. The enclosure for the roll-up mechanism is fashioned of particularly configured edge extrusions which, although being capable of shipment in knocked-down condition, are easily assembled to provide a strong but aesthetically pleasing framework for the panels of the housing enclosure.

BRIEF DESCRIPTION OF THE DRAWING

A better understanding of the present invention may be had from a consideration of the following detailed description, taken in conjunction with the accompanying drawings in which:

FIG. 2 is a rear elevational view of a security door system in accordance with the present invention;

FIG. 15 is a view of a sheet metal cutout for the end pieces of the barrel assembly housing;

FIG. 17 is a schematic sectional view of the barrel assembly for the arrangement of FIG. 2; and FIG. 18 is a detailed view, partially broken away, showing the position of the bottom of the door with affixed door stop in the fully retracted position.

DESCRIPTION OF THE PREFERRED EMBODIMENT

Figure 1:
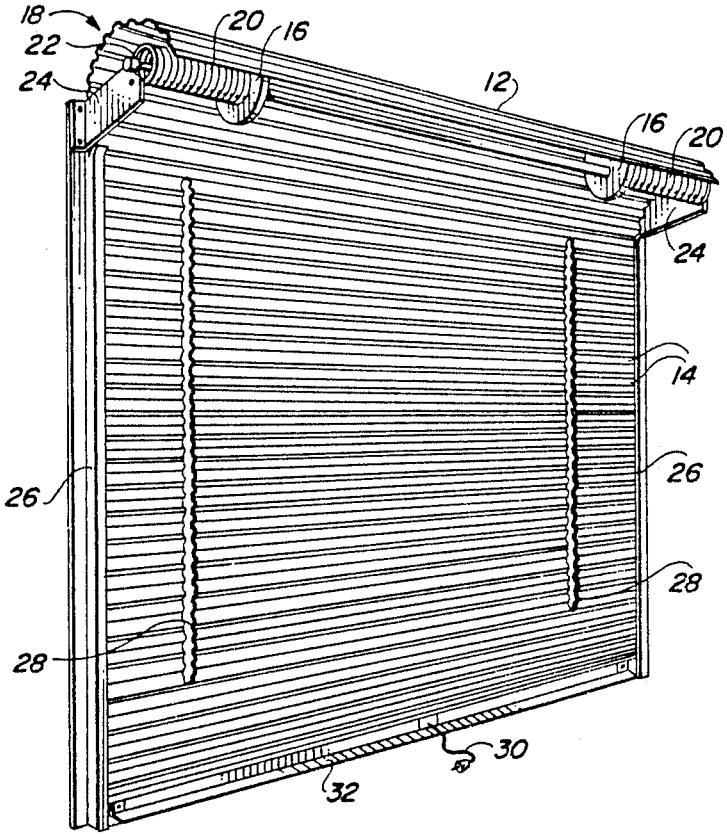
FIG. 1 (PRIOR ART)
FIG. 1 is a perspective view of a roll-up door system of the prior art.

FIG. 1 shows a roll-up door of the prior art, such as the type which is commonly used in mini-warehouse storage and the like. It comprises a curtain 12 formed of relatively thin sheet metal which is shaped to provide a plurality of horizontal corrugations 14. This configuration serves to stiffen the curtain against transversely applied forces while providing the door with sufficient flexibility to permit it to be rolled around the wheels 16 of a barrel assembly 18 at the top of the door curtain. The barrel assembly 18 includes a pair of pre-tensioned torsion springs 20 and an axle 22 by which the barrel assembly is mounted on a pair of bracket members 24. These brackets 24 are bolted to the door frame at the upper corners of the opening and support the entire assembly so that the opening is entirely clear with the door rolled up about the barrel assembly above the top of the door opening. Guide tracks 26 are fastened to the door frame along the sides of the opening to guide the curtain during its up and down movement. Flexible spacer/runners 28 are adhesively affixed to the door 12 in line with the positions of the wheels 16 to absorb the wear occasioned by the door bearing against the wheels and prevent abrasion between adjacent rolls when the door is being raised and lowered. A rope 30 is attached to an angle iron 32 installed along the bottom edge of the door 12.

FIG. 2 is a rear elevational view of a security door system in accordance with the present invention. As shown in FIG. 2, the system of the present invention principally comprises a housing assembly 40, door guides or tracks 42, a plurality of flexible door sections 44 and four reinforcing beams—a bottom edge beam 46, a slide lock beam 48, and two intermediate beams 50. The door guides 42 also provide the means for mounting the system in place along the back face of a door frame, typically inside a closet. Each door guide 42 is fabricated in sections so that the door system can be shipped in knocked-down kit form. Each section has mounting holes through which bolts 52 may be inserted and attached to the door frame.

Figure 3:
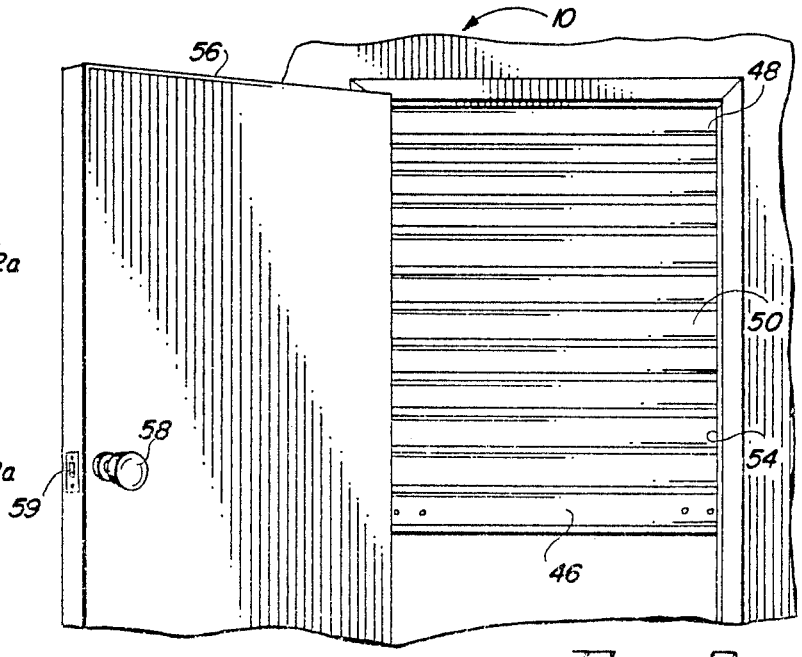
FIG. 3 is a partial view of a security door system in accordance with the present invention shown in a typical installation across a closet door opening.

FIG. 3 shows the front side of a door 10 in a typical installation across a closet doorway. As indicated in FIG. 3, the roll-up door is shown partially raised such that the bottom edge 46 is approximately at the level of the striker plate 54 of the closet door latch mechanism. The closet door 56 with doorknob 58 and latch 59 is shown in the open position. When closed, the closet door 56 completely conceals the security door system 10 from outside view.

Figure 4:
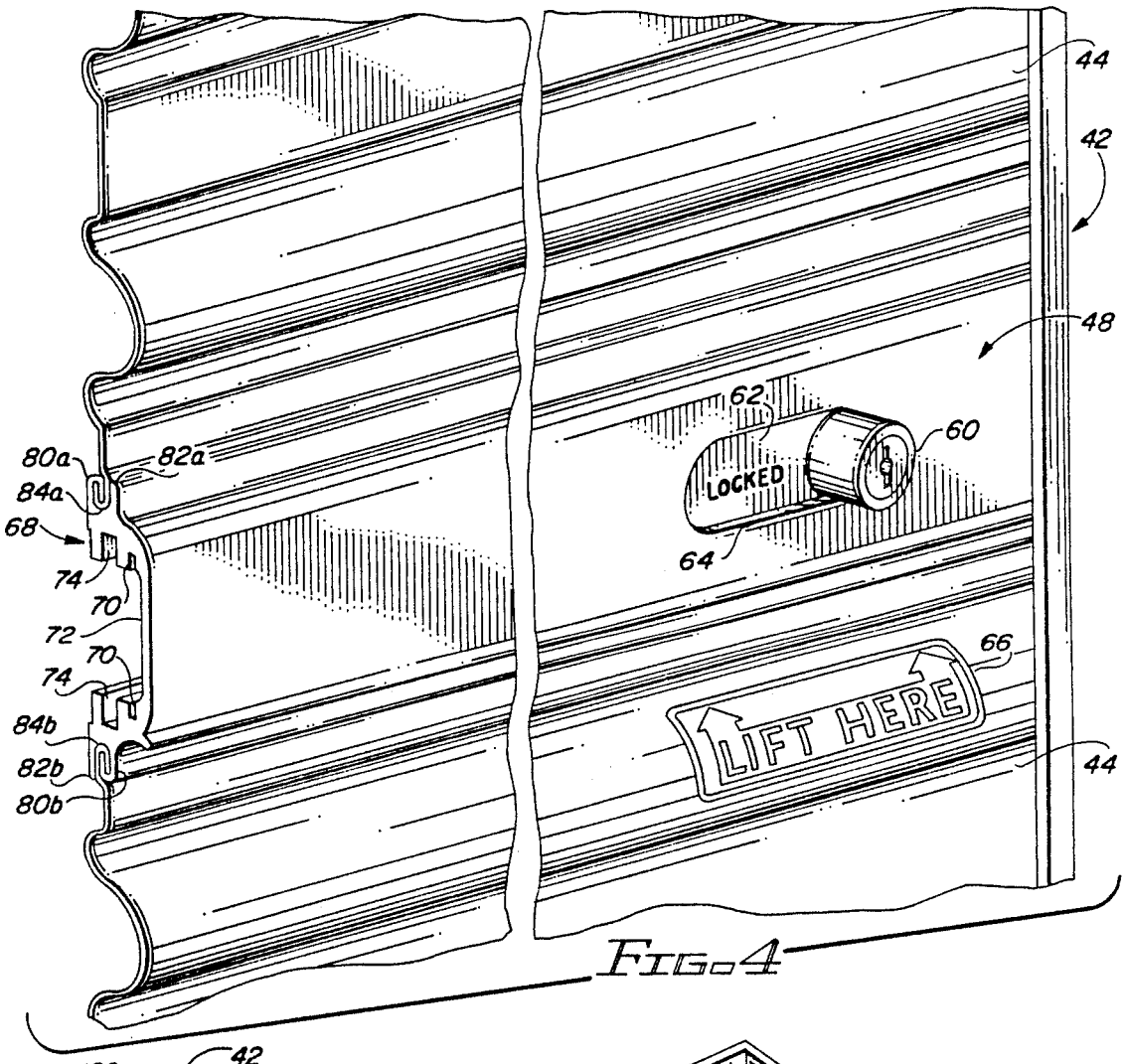
FIG. 4 is a cutaway view of the locking portion of the door of FIG. 2.

FIGS. 4–7 illustrate details of the slide bolt beam and the configuration of the interlocking arrangement between the beams and the curtain portions. FIG. 4 shows a portion of a roll-up door 10 including the slide bolt beam 48, adjacent curtain portions 44 and one of the track guides 42. Slide bolt key lock 60 is shown with the slide bolt in the locked position. The slide bolt assembly includes a label plate 62 which is mounted between the slide bolt and the inner face of the beam 48 and moves back and forth with the slide bolt and the lock 60. In the locked position, a tongue of the slide bolt, shown in FIGS. 5–7, engages an opening in the track guide 42 (see FIG. 12) to prevent the roll-up door from being raised. The key lock 60 locks the slide bolt in the position where the tongue is engaged in the track guide 42. When the key lock 60 and slide bolt assembly are slid to the left end of the slot 64 through which the key lock 60 protrudes, the slide bolt label plate 62 displays the word "UNLOCKED". A label 66 with the legend "LIFT HERE" and a pair of arrows pointing upward is mounted on the lower curtain portion 44 slightly below the slide bolt beam 48, indicating a concave finger grip portion which is part of the extruded shape of the slide bolt beam 48.

The cross sectional shape of the slide bolt beam extrusion may be seen from the left-hand end, indicated at 68. As shown there (and also in FIG. 6), a first pair of vertically extending recesses 70 is provided adjacent the inner surface 72 of the slide bolt beam 48. The recesses or slots 70 mount and guide the label plate 62, permitting it to slide from right to left with the key lock 60. A second pair of slots 74, substantially wider than the label plate slots 70, extends parallel to the slots 70. The slots 74 mount and guide the slide bolt and its attached assembly in side-to-side movement between locked and unlocked positions.

Figure 6:
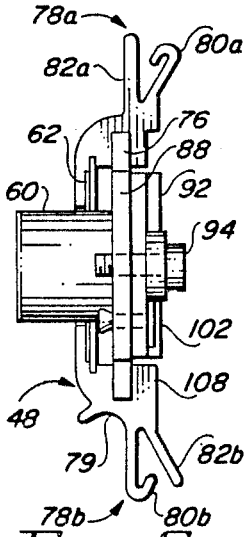
FIG. 6 is an edge view of the lock beam shown in FIG. 5.

The structural arrangement by which the slide bolt beam 48 is attached to adjacent curtain portions 44 is shown in the open, pre-assembly position in FIG. 6 and in the closed, attached position in FIG. 4. As indicated, the upper and lower attachment portions 78 of the slide bolt beam 48 comprise a re-entrant element, or ear, 80 and a backing, generally planar portion 82 which are part of the slide bolt beam extrusion and extend the full length of the beam 48. The upper ear 80*a*, as extruded, extends at an angle from the central plane of the beam 48, with which the backing member 82*a* is aligned. At the lower edge 78*b* of the beam 48, the relationship is reversed—the ear 80*b* is aligned with the central plane of the beam 48, whereas the backing member 82*b* is extruded at an angle to the beam plane. Each horizontal edge of a curtain portion 44 is provided with a mating re-entrant portion 84. During assembly, the re-entrant edges 84 of the curtain portions 44 are inserted into the opposite edges 78 of the beam 48, the angled portions 80*a*, 82*b* are bent toward the backing portions 82*a*, 80*b* and the resulting junctures are locked, thus providing a doubly re-entrant joint between each curtain portion 44 and the beam 48 as shown in FIG. 4. A similar juncture configuration is provided at each joint between the cross beams 46, 50 and the adjacent curtain portions 44 which are joined thereto.

Figure 5:
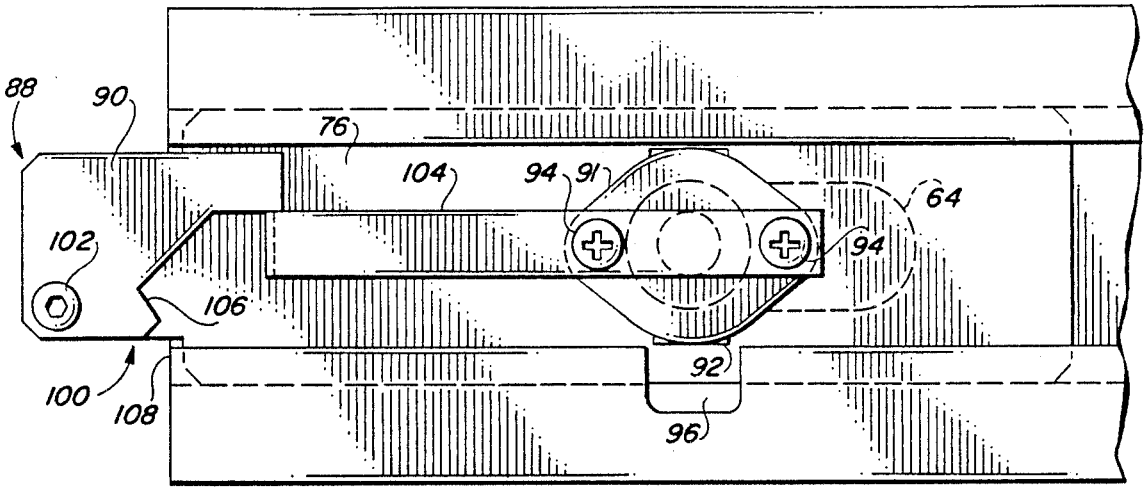
FIG. 5 is a rear elevational view of the lock arrangement of FIG. 4.

Further details of the slide bolt locking arrangement are best described in conjunction with FIGS. 5 and 6. The slide bolt 76 is shown having a tongue portion 88 (behind the re-lock member 90 as viewed in FIG. 5) which, as noted, extends into an opening in the adjacent track guide 42 when the slide bolt 76 is extended locking position, as shown in FIG. 5. The key lock 60 has a base plate 91 and locking tongue 92, best shown in FIG. 5. The base plate 91 is mounted to the slide bolt 76 by the screws 94. The slide bolt beam 48 includes a locking recess 96 for receiving the tongue 92. With the slide bolt 76 extended as shown in FIG. 5, the key lock 60 may be rotated to extend the tongue 92 into the recess 96, thereby preventing the slide bolt 76 from being retracted from the locked position. As soon as the tongue 92 is retracted into the key lock 60, the slide bolt 76 may be retracted from engagement with the track guide 42 so that the door may be raised.

The slide bolt assembly also includes a re-lock subassembly 100, which comprises the re-lock member 90 which is pivotably and eccentrically affixed to the extended tongue portion 88 of the slide bolt 76 by fastening means such as the rivet 102. A retaining spring 104, fashioned of strap metal and mounted by the same retaining screws 94 which affix the lock 60 to the slide bolt 76, serves to retain the re-lock member 90 in the position shown in FIG. 5. Should someone rupture the mounting of the key lock 60 from the slide bolt 76, as by hammering the lock from the outside so that the mounting screws 94 are dislodged and the tongue 92 no longer engages the recess and lock 96, the retaining spring 104 will also be dislodged. This releases the re-lock member 90, permitting it to rotate in a clockwise direction about the rivet 102. The re-lock latch portion 106 then engages the edge 108 at the end of the beam 48, and the slide bolt 76 is still prevented from being withdrawn from locking engagement with the track guide 42. By virtue of this arrangement, the door is still maintained in a locked position so that it cannot be opened by an intruder, even if the key lock is knocked off the slide bolt.

Figure 7:
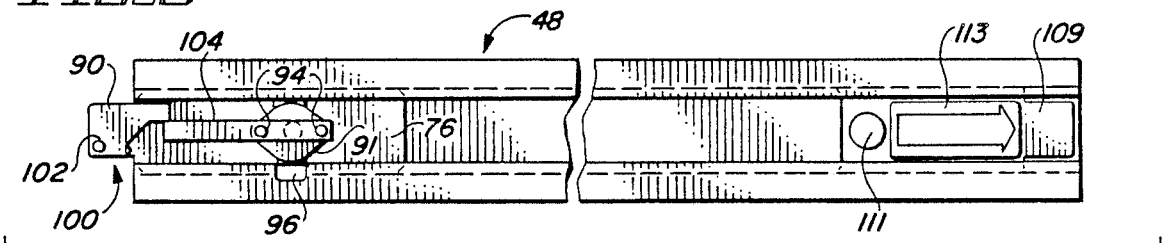
FIG. 7 is a view of the slide bolt beam of FIG. 5 showing a further locking arrangement incorporated therein.

FIG. 7 shows an auxiliary interior locking bolt arrangement in which a slidable, locking bolt 109 is shown at the opposite side of the beam 48 from the slide bolt 76. This is not accessible from the outside of the roll-up door 10, but is movable from the back side of the door by manual operation through use of the, finger hole 111. An arrow label 113 is placed on the slide bolt 109 to indicate the movement to lock the roll-up door from the inside of the closet or other space in which it is mounted. When the slide bolt 109 is moved to the right, as shown in FIG. 7, the tongue of the slide bolt 109 extends into an opening in the track guide 42, thereby preventing the door from being raised. The purpose of this is to provide a homeowner with some security against attack by an intruder, whereby the homeowner enters the closet, pulls down the roll-up, door and locks it by sliding the manually movable locking bolt 109 into position engaging the track guide 42. Thus the door cannot be raised, even though the primary slide bolt 76 is not moved to the extended, locking position.

Figure 8:
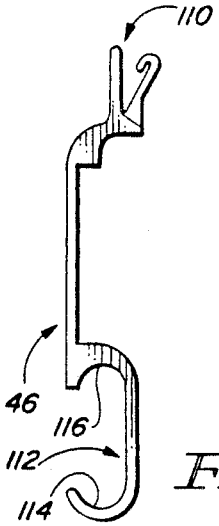
FIG. 8 shows an extrusion pattern for the bottom edge beam of the arrangement of FIG. 2.
Figure 9:
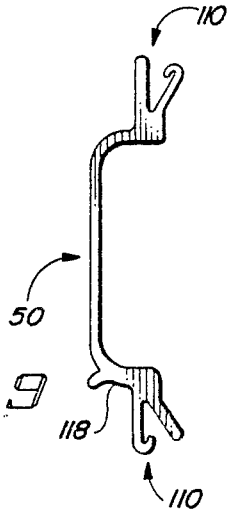
FIG. 9 shows an extrusion pattern for the cross beam of the door of FIG. 2.

FIG. 8 is an end view illustrating the configuration of the extruded cross beam 46 at the bottom of the roll-up door 10, and FIG. 9 is a similar view showing the shape of the extruded intermediate cross beams 50. It will be noted that each of these cross beams has a re-entrant joint configuration 110, similar to the joint configuration 78 of FIG. 6, for attachment to mating edges of adjacent curtain sections 44 in the manner illustrated in FIG. 4. The bottom beam 46 of FIG. 8 has a single such joint configuration 110 for attachment to the lowermost curtain section 44, whereas each intermediate beam 50 (FIG. 9) has two joint edge configurations 110 for attachment to adjacent curtain sections 44. The bottom cross beam 46 is shaped to provide a hand grip 112 at the bottom edge. This has a concave portion 114 along the lower portion of the hand grip section 112. Usually this portion 114 is used by inserting the fingers of one hand therein, with the thumb opposed, when the door is to be lowered from the rolled up position. An upper concave portion 116 is provided for gripping with the fingers if the hand grip section 112 is to be used for raising the door. The intermediate beam 50 of FIG. 9 is provided with a concave finger grip portion 118, opening downwardly at the lower portion of the cross beam 50, for use in raising the door. The somewhat convoluted shapes of the cross beams 46, 48, 50 as shown in FIGS. 6, 8 and 9 provide added strength for the horizontal cross beams with reduced thickness of the metal required to provide the needed structural rigidity.

Figure 14:
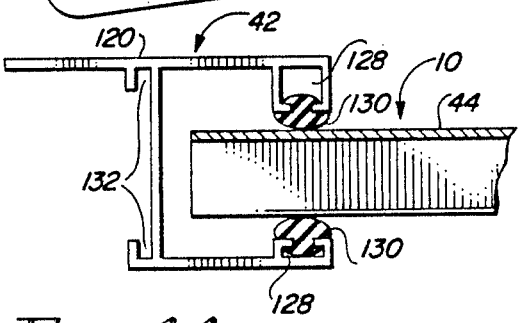
FIG. 14 is a sectional plan view showing a portion of the door positioned within the guide track of FIG. 10.
Figure 11:
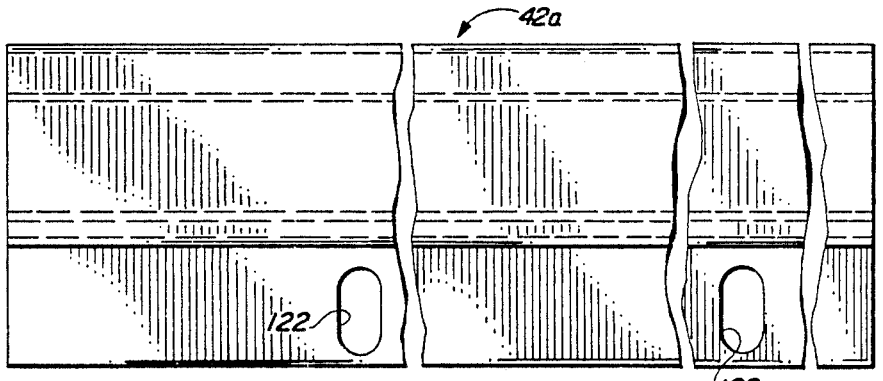
FIGS. 10, 11 and 12 are orthographic projection views of a track guide section for the door of FIG. 2.
Figure 10:
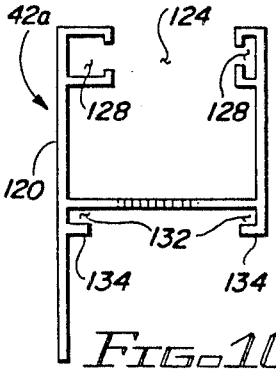
Figure 12:
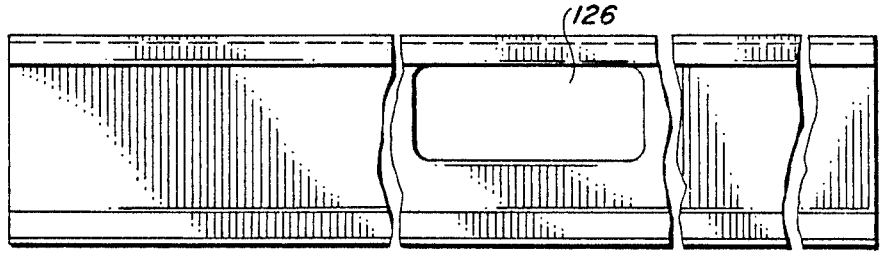

FIGS. 10, 11 and 12 are orthographic projection views of one of the guide track sections **42*a*. As shown, guide track section 42*a* includes an extended planar back surface portion 120 ("back" being the side that mounts against the door frame) in which mounting holes 122 are provided. Extending outward from the back portion 120 is a generally U-shaped section 124 with an opening along one side through which an edge of the roll-up door is inserted. Section 124 thus serves to guide the roll-up door during its vertical movement. As indicated in FIG. 12, the bottom of the U-shaped guide section 124 has an opening 126 which is provided for receiving the tongue portion 88 of the slide bolt 76 through the slide bolt beam 48. Should the guide track section 42*a* be located at the other end of the slide bolt beam 48, the opening 126 serves to receive the tongue of the other locking slide bolt 109. The upper portions of the two sides of the U-shaped section 124 are generally C-shaped elements 128 for the purpose of receiving and retaining plastic guide elements 130 (see FIG. 14). On the outside of the U-shaped portion 124 is a pair of a opposed slots 132 defined by projections 134**.

Figure 13:
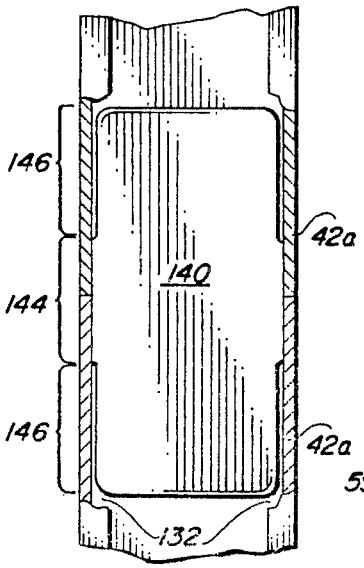
FIG. 13 is a view, partially broken away, showing the manner in which section of the guide track are spliced together.

It will be understood that the guide track 42 is provided in a plurality of sections such as **42*a* so that the door unit may be shipped in compact disassembled form. The guide track sections 42*a* are designed to be assembled by joining them together end-to-end. In a typical installation, each section 42*a* is 27" long so that three such sections would be joined longitudinally to provide a guide track up to 81" in length. One of the sections on each side of the door frame may be cut to fit the frame as appropriate. The guide track sections 42*a* are spliced together by a track splice 140 in the manner shown in FIG. 13. The track splice 140 is merely a rectangular piece of metal (e.g., steel) having a thickness corresponding generally to the slots 132 (FIG. 10), a mid portion 144 having a width which develops a force fit in the slots 132, and opposite end sections 146 of slightly reduced width so that they can be inserted easily into the slots 132. Adjacent guide track sections 42*a* are assembled by inserting a track splice 140 into the slots 132 of one section 42*a***, then slipping the next section 42*a* onto the track splice 140 with the other end in the slots 132 and hammering the two sections 42*a* together so that the configuration of the splice illustrated in FIG. 13 is generally realized. After the track guides 42 (one for each side of the door) are assembled in this fashion, the flexible plastic door slides 130 are inserted in the C-shaped sections 128 so that the door 10 may be guided easily during raising and lowering in the manner indicated in FIG. 14.

Figure 16:
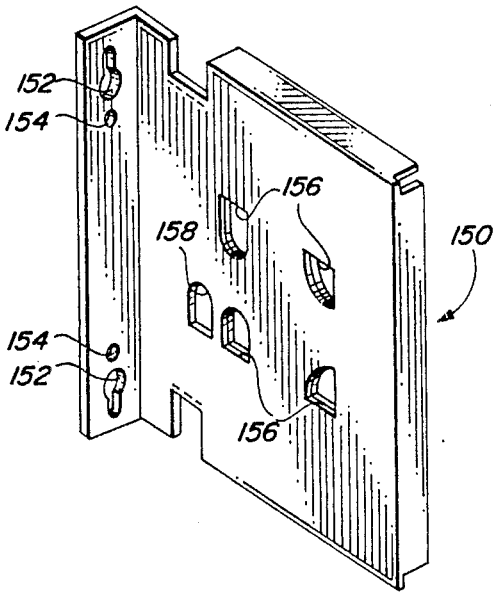
FIG. 16 is a perspective view showing the sheet metal cutout of FIG. 15 shaped in to an end bracket.

FIGS. 15 and 16 shows details of the structure of side support brackets which are provided on either side of the upper housing 40 (FIG. 2). The end plate pattern as shown in FIG. 15 is designed to be symmetrical so that it may be used on either side of the housing as a support bracket for the barrel assembly in which the door is rolled up. FIG. 15 shows the support bracket 150 as a stamping and before braking to develop the three-dimensional shape shown in FIG. 16. Bracket 150 has a pair of bolt hanger cutouts 152 which permit the bracket 150 to be used either side up. Retainer screw openings 154 are provided for locking the bracket 150 in position after it is hung on a bolt extending through the hanger opening 152.

The bracket 150 is stamped with four offset retainer elements 156 which are offset from the plane of the bracket by sufficient clearance to permit the base of a hub element to be mounted on the bracket 150. Stop element 158 is offset from the plane of the bracket 150 to a lesser degree, thereby serving to fix the position of the axle support hub as retained by the offset elements 156.

Figure 16A:
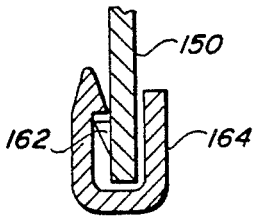
FIG. 16A is a detailed view in section of a portion of FIG. 16.

The bracket 150 is provided with symmetrically located cutouts 160 and is lanced at three places 162 adjacent each cutout 160. These lance points 162 serve to retain a generally U-shaped plastic bumper 164 as shown in FIG. 16A for the head stops 47 which are bolted to the bottom beam 46 (see FIG. 2). These head stops 47 are generally Z-shaped with a portion thereof projecting outwardly from the bottom beam 46 beyond the outer portion of the guide track 42. When the door is fully rolled up, the outwardly projecting portions of the head stops 47 enter of the brackets 150 and are stopped by the bumpers 164 the cutouts 160 of the brackets 150 and are stopped by the bumpers 164 (see FIG. 18).

Each bracket 150 has three flanges 166 which are bent at 90° to the plane of the bracket 150 in a direction facing inwardly of the housing 40. These serve to support the sides of the housing 40, which may be sheets of ⅛" pressed fiberboard. Horizontal moldings 170 are screwed to the flanges 166 and also serve to hold the fiberboard pieces 168 in position.

FIG. 17 is a schematic sectional view of the barrel assembly which is mounted within the housing 40. Stamped sheet metal hubs 180 are shown with base portions being retained against the adjacent brackets 150 by means of the offset retaining elements 156. Each hub 180 is formed with a central opening 182 shaped with a re-entrant bushing 184 to support the barrel assembly axle 186 which is mounted for rotation therein.

Axle 186 has a pair of wheels 188 secured thereon for rolling up the door 10. A torsion spring 190 is shown attached at one end to one of the wheels 188 by means of a pin 192. The spring 190 is attached at its opposite end to the adjacent hub 180 by a second pin 194. A second torsion spring may be installed at the opposite end of the axle 186, if needed.

In use, the various components making up the system of the roll-up door of the present invention are assembled in the manner indicated and the assembled unit is installed as shown in FIG. 2. The door may be raised or lowered by using the finger cavities of the various cross beams as described. When the door is raised, the head stops 47 keep the bottom beam from moving all the way into the housing. The pre-torqued torsion spring 190 balances the weight of the door so that the door may be moved easily up or down. The door may be locked in the closed position if desired. The curtain sections 44 permit the door to be rolled about the barrel assembly within the housing 40 while the cross beams 46, 48 and 50 provide reinforcement of the thinner curtain sections 44 so that rather extreme force is required in order to batter the door open.

Arrangements in accordance with the present invention thus provide a simple but effective and economical way for a user of the product to secure a closet or the like against break-in by the usual burglar or thief. The design and construction of the preferred embodiment are such that the door system may be readily installed in the doorway of a closet, for example, and enable the door system to be fabricated for shipment in kit form and easily assembled and installed by the average homeowner. This design permits it to be manufactured at low cost with the resulting installation being long lasting and essentially trouble free. Even after an initial installation, the door system is susceptible of moving for relocation, if desired, since the door can be rolled up into the housing, which can then be removed and transported as a unit. The track guides are capable of disassembly and re-assembly.

Although there have been described above specific arrangements of a security door system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A security door system comprising:

a barrel assembly for mounting adjacent the upper edge of a door opening to provide support means rotatable about the horizontal axis;

a roll-up door positionable across said door opening and susceptible of being rolled about said barrel assembly as the door is raised, the door including a plurality of flexible panels and a plurality of rigid metal reinforcing beams interspersed between adjacent pairs of panels and along the bottom of the lowermost panel in a combination which can be rolled about a horizontal axis; said reinforcing beams comprising a bottom edge beam, a slide lock beam, and a pair of intermediate beams, one on either side of the slide lock beam, each beam being separated from an adjacent beam by a flexible metal panel which is joined thereto;

vertical door guide members for installing at opposite sides of the door to encompass the side edges of the opening;

said slide lock beam including a slide bolt mounted for limited movement along an inner face of the side lock beam, a locking member having an extendible tongue for locking the slide bolt in a locked position, a notched portion for receiving the extended tongue of the locking member, and means defining an aperture in a vertical door guide member in line with the slide bolt when the door is in the closed position in order to lock the door closed, the locking member being affixed to the slide bolt from a rearward side thereof by mounting means extending from the locking member to the slide bolt;

a re-lock assembly having an eccentrically pivoted plate mounted to the slide bolt and configured to engage one end of the slide bolt beam when extended downwardly about its mounting pivot, said re-lock assembly further including a releasable restraining member for engaging the pivoted plate in a retracted position; and common mounting means securing said restraining member and the locking member to the slide bolt in a manner such that removal of the locking member from the slide bolt also removes the restraining means, thereby allowing the pivoted plate to rotate into a position to engage the end of the slide bolt beam and prevent the slide bolt from being retracted.

2. The system of claim 1 wherein said locking member comprises a keyed lock fixedly mounted to the slide bolt and extending through an aperture in the slide bolt beam to protrude from an outer face of the beam, said aperture being elongated in a direction along the beam to define the limit of travel of the slide bolt in a transverse direction relative to the door.

3. The system of claim 2 further including a slide bolt label plate displaying indicia which is visible through said aperture to indicate the locked or unlocked position of the slide bolt.

4. The system of claim 1 wherein said vertical door guide members comprise a plurality of like sections which are joinable to each other in end-to-end relationship, each section including an extended planar back surface portion having means defining a plurality of mounting holes, a generally U-shaped portion extending from the back portion and having a longitudinal opening facing oppositely from the mounting holes, the U-shaped portion having one side in common with the back portion and being adapted to receive a vertical edge of the roll-up door in guiding relationship.

5. The system of claim 4 wherein each door guide section further includes a pair of opposed C-shaped elements extending along the guide member on opposite sides of the opening of the U-shaped portion, each C-shaped element including means for receiving and retaining a plastic guide element in an attitude facing the opening of the U-shaped portion.

6. The system of claim 5 further including means defining a pair of opposed slots extending along the base of the U-shaped portion and on the outside thereof for receiving a track splice member to join adjacent door guide sections together.

7. The system of claim 6 further including a track splice member of elongated metal having a thickness corresponding generally to said slots, a mid portion having a width which develops a force fit in said slots and opposite end sections of slightly reduced width to permit insertion easily into the slots.

8. The system of claim 1 further including a pair of opposed side brackets for supporting the barrel assembly, each bracket having first mounting means defining openings for affixing the bracket to a door frame and second mounting means comprising stamped offset retainer elements which are offset from the bracket with sufficient clearance to permit a sheet metal hub element to be inserted between the retainer elements and the bracket.

9. The system of claim 8 wherein each bracket defines a pair of symmetrically located cutouts with lance points adjacent thereto to retain bumper means within said cutouts.

10. The system of claim 9 wherein one reinforcing beam at the bottom of the roll-up door includes a pair of generally Z-shaped head stops fastened thereto at opposite ends of said beam, said head stops having portions which are positioned to engage said support bracket cutouts when the door is raised to the rolled up position, thereby preventing the bottom beam from passing the edge of the cutouts.

11. The system of claim 1 wherein the barrel assembly comprises a rotatable axle, a pair of wheels mounted for rotation with said axle, a pair of opposed hub members surrounding the axle at opposite ends thereof including bearing portions for rotatably supporting the axle, a torsion member extending from one of said wheels to an adjacent hub member for preloading the wheel and axle combination, and means for supporting the barrel assembly with the axle in a horizontal orientation in a position above an opening to be secured by the roll-up door.

12. The system of claim 11 wherein the supporting means comprises a pair of symmetrically formed brackets of stamped sheet metal situated at opposite ends of the rotatable axle and including means for mounting the hub members thereon.

13. The system of claim 12 wherein said brackets are formed identically in a vertically symmetrical configuration so that the same bracket shape may be installed either side up at opposite ends of the axle.

14. The system of claim 1 further including a housing enclosing the barrel assembly, said housing comprising a pair of opposed end support brackets, generally planar fiberboard panels extending between said brackets on top, bottom and side faces thereof, and a pair of horizontal corner moldings extending between the brackets to hold the fiberboard panels in position.

15. The system of claim 2 further including auxiliary locking means accessible only from a rearward side of the roll-up door.

16. The system of claim 15 wherein said auxiliary locking means comprise a second slide bolt mounted in a pair of tracks in the slide bolt beam for sliding movement relative thereto, the second slide bolt being manually extendible relative to the slide bolt beam to project into an aligned opening in an adjacent door guide member.

17. The system of claim 16 wherein the second slide bolt includes means defining a finger opening to permit the second slide bolt to be manipulated from the rearward side of the door, the second slide bolt being inaccessible except from the rearward side of the door.

18. The system of claim 1 wherein each of said beams is configured with a downwardly facing, concave portion to provide a finger grip for raising the door.

19. The system of claim 18 wherein said bottom edge beam includes a lower edge section having both upwardly facing and downwardly facing concave portions for affording finger grip means for both raising and lowering the door.

* * * * *